United States Patent [19]

Sumrall

[11] Patent Number: 5,066,015

[45] Date of Patent: Nov. 19, 1991

[54] BOARD GAME APPARATUS AND METHOD OF PLAYING

[76] Inventor: Terry Sumrall, 5953 Hopper St., Houston, Tex. 77016

[21] Appl. No.: 587,269

[22] Filed: Sep. 24, 1990

[51] Int. Cl.[5] ..... A63F 3/00

[52] U.S. Cl. ..... 273/243; 273/276; 273/290

[58] Field of Search ..... 273/243, 248, 249-254, 273/256, 276, 288-290

[56] References Cited

U.S. PATENT DOCUMENTS

| | | | |
|---|---|---|---|
| 1,338,502 | 4/1920 | Gay | 273/248 |
| 2,977,713 | 4/1961 | Alelyunas | 273/249 |
| 3,656,757 | 4/1972 | Carroll | 273/243 |

FOREIGN PATENT DOCUMENTS

| | | | |
|---|---|---|---|
| 645661 | 11/1950 | United Kingdom | 273/249 |
| 798725 | 7/1958 | United Kingdom | 273/252 |

*Primary Examiner*—Benjamin Layno

*Attorney, Agent, or Firm*—Kenneth A. Roddy

[57] ABSTRACT

A board game based on a railroad theme is provided wherein the players each assemble the necessary components of a complete railroad train, under rules simulating conditions normally existing in the marshalling yard of a conventional railroad system. The gameboard has a playing surface depicting the trackage, switches and other elements of a marshalling yard. A plurality of playing pieces represent the players and have a changeable status or rank. Other pieces are included which represent messages sent from the yard dispatcher to the players during play of the game and train components. The tokens are moved about the trackage according to values established by casting dice, by the use of a spinner, or other chance device for establishing values at random. The goal of each player is to acquire a locomotive, and thereafter to collect all of the other rolling stock needed to make up a complete train, before any of the other players. However, each player begins the game with the rank of "fireman", and before being entitled to operate a locomotive and to collect any of the rolling stock, must first achieve promotion to the rank of "engineer". The rank of "engineer" is denoted by a small playing piece in the shape of a hat which is placed onto the head of the "fireman".

2 Claims, 1 Drawing Sheet

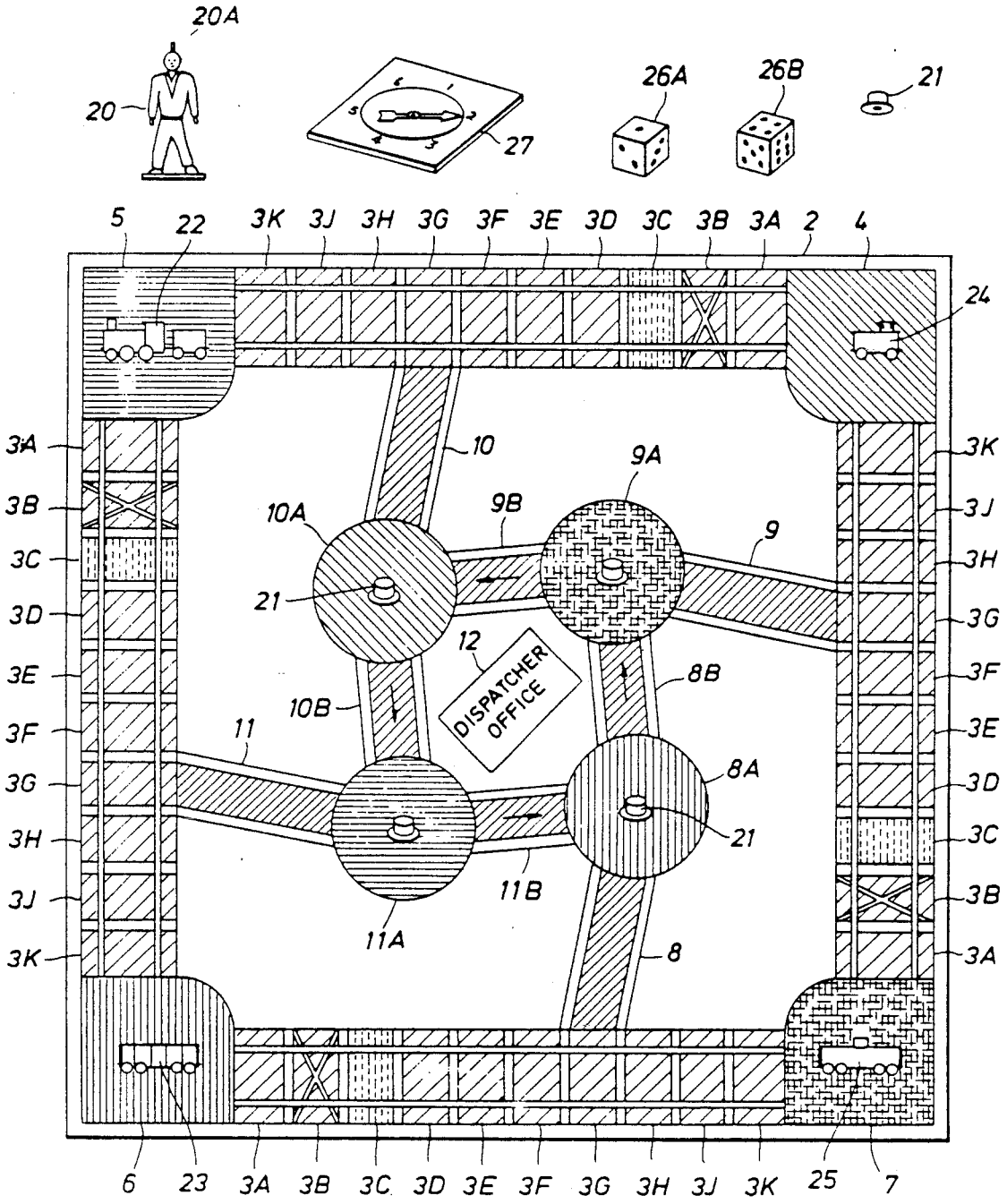
20A
20
27
26A
26B
21
5
22
3K
3J
3H
3G
3F
3E
3D
3C
3B
3A
2
4
24
10
9A
9B
10A
9
21
12
DISPATCHER OFFICE
8B
10B
11
8A
21
11B
11A
8
6
23
25
7

BOARD GAME APPARATUS AND METHOD OF PLAYING

This application is related to U.S. patent application Ser. No. 07/264,987 filed 10/31/88, now abandoned.

BACKGROUND OF INVENTION

This invention relates to board games and the like, and more particularly relates to board games using tokens with values of variable significance.

It is well known that board-type games have long been designed to employ a balance of both skill and chance, and that such games may therefore be used to provide both instruction as well as amusement. It is also well known that a board-type game may be targeted toward a particular class of player by selecting that balance of skill and chance. A game which is intended for children will tend to emphasize the chance factor, whereas a game which is designed for more mature players may emphasize the player's ability to perceive and comprehend abstract mathematical or other similar relationships which tend to occur on a random basis.

A further variation on this concept is apparent with games of this type which are further designed to simulate, or at least suggest, actions and conditions which commonly occur during participation in some real life endeavor or activity. It is well known that the game of chess is designed to be suggestive of military combat, although chess actually requires the participant to comprehend and make decisions solely on the basis of changing geometric relationships.

The well known game of "Monopoly" is designed to simulate and encourage interest in investment in real estate and other like properties. In contrast with chess, this type of board game subjects the player to random situation changes whereby the player is required to make judgments, not on the basis of controllable but abstract geometric relationships, but on the basis of probabilities involving random changes in simulated situations involving real estate investment. In this sense, it will be apparent that when the rules and design of the game involve a combination of both chance and skill, the balance between these two conflicting aspects will be significant in targeting players of a particular level of educational development. In addition, however, it will also be apparent that, when the game is designed to simulate the details of a real life activity, the educational aspects of the game is often enhanced. If the conditions being simulated are sufficiently realistic, a player may acquire a degree of skill and knowledge appropriate to actual participation in the business or activity being simulated by the game.

For example, it is well known that staff officers in many military establishments are regularly trained in part by the use of extremely realistic board-type "war games." In the case of most popular board-type games, however, the real-life situations are not that realistically simulated, and thus most popular board games are merely expected to acquaint the player with the existence and certain elemental aspects of the activity being simulated. To the extent that such games significantly extend the intellectual capacities of the player, it is in the degree that the player subconsciously or indirectly improves his capacity to recognize and make appropriate decisions involving the abstract relationships such as those hereinbefore mentioned. Nevertheless, it will be recognized that the character and type of real-life situation being simulated are suggested, will often serve to attract the interest of many players, and that the design of the game also involves a careful balance between the manner of simulation or representation of that situation and the presentation of the geometrical or other concepts which provide the true challenges to the players.

Many board-type games have been proposed and designed to satisfy one or more of the purposes and objectives hereinbefore mentioned, but in all cases at least one of these purposes has been sacrificed or ignored in order to effectively achieve one or more of the others. As hereinbefore noted, so-called "war games" and the like have been devised which can effectively train the player to effectively perform when actually placed in the situation being simulated by the board game. However, not only does such a game require advance preparation and training merely to be effectively "played", such a game rarely has any entertainment value outside of those having a professional interest in the activity being simulated.

Alternatively, there can be no denial that a board game such as "Monopoly" will have broad appeal and entertainment value for many different types and ages of players, and that such a game may be effectively played with a minimum of advance instruction or preparation. However, a board game of this type has comparatively little instructional value, in that the real life situation being simulated (real estate investment) is not realistically depicted or represented, and because the balance between skill and chance is overwhelmingly tilted in favor of random changes in the situations facing the player. More important, there is little clear relationship between the details of business being simulated, and the type of challenges being presented to the players of such a game.

These deficiencies and limitations in the prior art are overcome with the present invention, and a new and improved board-type game is now provided which has appeal to broader classes of players, and which nevertheless provides effective educational value to the broad variety of players sought to be targeted.

SUMMARY OF INVENTION

In a preferred embodiment of the present invention, a board-type game is provided which includes a playing board having a predetermined track indicated on its surface, and which further includes a plurality of tokens and the like which are positioned on and movable along the track on the board. These tokens and other playing pieces are movable on the track, in response to events occurring in random, but also as a function of their positions relative to the configuration of the track as well as each other.

The real-life activity intended to be simulated or suggested herein is that aspect of railroading wherein a train is "made up" for the purpose of carrying freight and/or passengers from one location to another. More particularly, what is simulated is the task of assembling the engine and the other components (cars) into the assembled train. The playing board simulates or represents the trackage of a typical marshalling yard, and the various tokens and their movements on the playing board are intended to simulate the activity of collecting and assembling the cars needed to make up a train. In addition, the rules of the game also call for distinguishing between an "engineer" and a "fireman," insofar as the limitations are imposed on each player, and whereby the licensing authority of the Interstate Commerce Commission is also simulated in a realistic manner. In contrast, however, random changes in the playing situation are preferably created by the use of dice.

It is well known that railroad systems usually include one or more marshalling yards which serve as parking for rolling stock, as well as various trunk lines extending between locations sought to be served. When a train is sought to be "made up", it is usual practice for a so-called "yard engineer" to first select an engine, and to thereafter move about the marshalling yard to find and select those cars which are required for the train sought to be assembled. In order to realistically simulate the complexity of such a task, it should first be noted that only a duly qualified engineer is permitted to actually operate a railroad locomotive engine. Accordingly, each player is initially designated a "fireman", and no player is permitted to take up an engine and begin collecting the cars needed to complete a train until he has first qualified as a duly licensed engineer.

In the preferred form of the present invention, each player is identified by his own playing piece which is shaped to resemble a railroad worker such as a fireman and the like. More particularly, promotion to the grade or status of engineer is simulated by a separate playing piece which is shaped like a hat, and which is further adapted to be releasably fitted onto the head portion of the playing piece assembling the fireman. Consequently, those players having the status of engineer will be indicated by the fact that their playing pieces are wearing hats, whereas those having only the status of fireman will be denoted by the fact that their respective playing pieces are hatless.

Realism is further simulated by including a set of cards or "dispatcher messages", which the players may encounter and be required to receive and obey as they move their respective pieces about the playing board. Moves, of course, are subject to the elements of chance since they are determined by the fall of dice, or by the operation of a spinner or the like, in order to simulate the type of fluid situation which is everpresent in any busy marshalling yard. Finally, the engines and other rolling stock may be simulated in various ways, as by providing playing pieces shaped to resemble different types of such rolling stock, or by merely the use of other types of cards bearing pictures of the rolling stock sought to be represented.

In a first stage of the game, each player will move his respective "fireman" about the trackage represented on the playing board, in accordance with a cast of the dice, or a rotation of a spinner and the like, until he manages to acquire a hat piece. Thereafter, he can collect cars until he has made up a full and complete train. As in real life, an engineer may lose his status and suffer demotion back to fireman. When this occurs in the game, the player removes the hat from his playing piece, to signify his demotion to fireman status and to indicate that he is no longer privileged or qualified to operate a locomotive and to thereby collect the cars needed to make up a complete train.

As hereinbefore indicated, the objective of each player is to acquire promotion to the status of engineer, and to collect all of the rolling stock required to make up a complete train within the marshalling yard represented by the trackage, switches and other aspects of the system depicted on the playing board. Accordingly, the first player to succeed in reaching this objective is the winner of the game.

Accordingly, it is an object of the present invention to provide a board-type game and method of play which is both instructive and entertaining, and which is also directed to a broad range of different types of players.

It is also an object of the present invention to provide a board-type game and method of play, wherein the player is presented with a simulation of a real-life situation, and wherein the challenges to the player require decisions having relevance to the details and aspects of the situation being simulated.

It is further an object of the present invention to provide a board-type game and method of play involving both skill and chance, and wherein playing situations are created in a manner and form to simulate events and circumstances arising in a real-life situation.

It is a particular object of the present invention to provide a board-type game comprising a gameboard having a rectangular playing surface representing a railroad marshalling yard and the like, a first plurality of movable playing pieces each representing a railroad employee having the status of fireman, a second plurality of playing pieces each representative of a locomotive, a third plurality of playing pieces each representative of a caboose, a fourth plurality of playing pieces each representative of another different type of railroad rolling stock, a fifth plurality of playing pieces each representative of another further different type of railroad rolling stock, and a sixth plurality of playing pieces each representative of the status of railroad engineer.

These and other objects and features of the present invention will become apparent from the following description, wherein reference is made to the figures in the accompanying drawing.

IN THE DRAWING

FIG. 1 is a simplified pictorial representation of the playing surface of a game board suitable for the purposes of the present invention.

DETAILED DESCRIPTION

As hereinbefore stated, the present invention is directed to and preferably embodied in a board-type game involving a plurality of competing players, and wherein the objective is to assemble the components of a railroad train before any of the other players. Accordingly, the game is played by moving selected tokens in a systematic and orderly manner about the playing surface of a suitable game board under circumstances tending to simulate comparable real-life activity within a typical marshalling yard.

Referring now to FIG. 1, there may be seen a simplified pictorial representation of the playing surface of a game board 2 suitable for the purpose of the present invention and suggestive of trackage in a typical marshalling yard of a railroad system. In an actual marshalling yard, a series of tracks are laid in parallel with each other, and are interconnected by switches and the like. Cars and other types of rolling stock not in use are parked on these tracks until needed to make up a train. When that requirement arises, a switch engine or the like is employed to collect and relocate designated cars into a location where they may be assembled into a train.

In a real-life situation, a standard heavy-duty locomotive is then substituted for the switch engine, and the train may then leave the yard for its intended destination. In the present invention, however, the game ends when one player assembles all of the components of a complete train.

As previously indicated, actual operating conditions in a typical marshalling yard may be simulated in one or both of two ways in the present invention, depending upon the maturity and educational level of the players. The layout of the railroad network provided on the playing board may be defined in more or less complexity whereby the players are required to recognize and cope with certain geometric relationships in order to reach and obtain a particular item of rolling stock, and the messages from the dispatcher may be composed to correspond with orders from the yardmaster requiring compliance with such factors as labor agreements and rulings by the Interstate Commerce Commission. Alternatively, the marshalling yard provided on the playing surface of the board may simply suggest rather than attempt to simulate the details of an actual marshalling yard, and the switches in such a network may be located merely to enhance and maintain the interest of players in the pre-teen category. In such a form of the present invention, the messages from the dispatcher may be worded to introduce simple but nevertheless interest-sustaining conditions into the environment of the game.

In the more advanced form of the game, the depicted marshalling yard will be presented so that a player must solve geometrical problems in order to reach a particular item of rolling stock in most expeditious manner. In a less advanced form of the game, the difficulty of moving one's switch engine to a particular item of rolling stock is created by requiring the player to move to a particular track location in accordance with values established by a roll of the dice.

Another feature of the subject game involves the fact that, in railroading a licensed "fireman" is authorized and empowered to perform only limited tasks in the marshalling yard, whereas only a duly licensed "engineer" is authorized and empowered to operate a suitable switch engine or other prime mover. In the game, this situation is effectively represented or simulated by initially denoting or characterizing each player as a "fireman", and by requiring each player to move his respective identifying token to a designated location on the playing surface of the game board in order to achieve the status and privilege of an "engineer."

In both versions of the present invention each player will move his token about the game board, as determined by the roll of suitable dice, but until he becomes an "engineer" he may not collect any of the cars necessary to make up a train. Once he achieves the status of "engineer," however, he may then begin collecting the cars and other rolling stock necessary to make up his train, and the first player to make up a full train (by accumulating a full set of the appropriate tokens representing the different types of rolling stock), becomes the winner of the game.

In the present invention, a complete train includes not only an engine and tender, but also a box car, a tank car, and a caboose. Each type of rolling stock is available only at a different particular location on the game board, and thus a player must collect one of each of these four types of rolling stock by moving his respective token to that particular location. Furthermore, it should be remembered that a player may only collect an item of rolling stock if he has first qualified and been promoted from his initial status as "fireman" to that of "engineer."

Referring again to the game board 2 depicted in FIG. 1, it may be seen that its playing surface is designed to illustrate trackage 3 extending about the perimeter or border of the game board 2, and extending between and interconnecting four corner stations 4–7 in the marshalling yard being simulated or suggested by the trackage 3. Station 4, which is located at one of the four corners of the game board 2, represents the location in the marshalling yard where the cabooses are positioned. Accordingly, a player may collect a caboose for his respective train by moving his token onto station 4, but only if his token has first been promoted from its initial status of "fireman" to that of "engineer." In this regard, each of the four cabooses (one for each player) may be represented by cards or other suitable pieces which may be conveniently stacked adjacent station 4. Whenever a player collects one of the cabooses for his respective train, he may so indicate by removing one of the cards or pieces located on or adjacent station 4.

Referring again to FIG. 1, it may be seen that station 5 in the trackage 3 represents the location where the four locomotives with tenders are located in the marshalling yard sought to be simulated, and that four cards or other suitable pieces indicative of these four locomotives may be stacked or arranged adjacent station 5. Similarly, station 6 in the trackage represents the yard location of four box cars, and therefore four cards or other suitable pieces may be stacked or arranged adjacent station 6 as hereinbefore suggested. In the same manner, station 7 represents the yard location of four oil cars, and therefore four cards or other pieces representing these oil cars may appropriately be stacked or arranged on the game board 2 on or adjacent station 7.

Referring again to the game board 2 depicted in FIG. 1, it may be noted that the marshalling yard suggested by the trackage 3 also includes four shunts 8-11 each interconnecting with a different one of four "depots" 8A–11A located in a rectangular spaced-apart arrangement in the center of the game board 2, and interconnected with each other by additional shunts 8B–11B. In addition, a plurality of suitable cards bearing instructions are appropriately stacked or arranged at a dispatcher office 12 located at the center of the game board 2, to simulate and represent messages issued to the players by the dispatcher at the marshalling yard. The issuance of a message from the dispatcher is simulated, in the present invention, when a player is required to move his token to one of the spaces 11A–D, whereupon he must then draw and obey the message on the top card of the message stack or dispatch office 12.

It will be noted that the trackage 3 is further designed to include ten spaces 3A–K along each side of the game board 2. Each player selects and places his respective token at one of the four stations 4–7, at the beginning of each game, and thereafter each player moves his respective token progressively in a counterclockwise direction along the trackage 3, according to the roll of a single die 26 or the action of some other randomly-operated device such as a spinner 27 or the like. Thus, if the player with his token located initially at station 4 rolls a one with the die 26, he will move his token from station 4 to space 3 in the trackage 3 extending between stations 4 and 5. If his initial roll turns up a two on the die 26, however, he will move his token to space 3B in the trackage which, as indicated by its color and design, represents a signal block in the marshalling yard. In this event, that player will then immediately move his token forward two additional spaces to space 3D in the trackage 3.

If that player happens to roll a three with his die, he will move his token forward to space 3C in the trackage 3. It will be noted, however, that space 3C represents a communication from the dispatch office 12, however, and therefore he will immediately draw a message card and comply with whatever instruction is contained on that card. After compliance, he will return the message card to the bottom of the stack at the dispatch office 12, before the next player takes his respective turn with the die 26.

Referring again to FIG. 1, it may be noted that the seventh space 3G in the trackage 3, which is located between stations 4 and 5, represents a switch which interconnects shunt 10 with the trackage 3 at that location. If the player is required to place his token at switch 3G, (by an appropriate roll of the dice), he will then immediately move his token also from the switch 3G to the position on the game board 2 identified as depot 10A.

As hereinbefore noticed, the game board 2 and various other components of the subject invention are preferably intended to simulate the real-life activities extant in a typical marshalling yard of a railroad system, including the circumstances involved in the relative differences between a "fireman" and a qualified or licensed "engineer." In the present invention, these circumstances are preferably simulated or suggested by locating a hat-like token 21 at each of the four depots 8A–11A. In addition, each player token 20 will preferably be fashioned to have the appearance of a typical railroad worker, but will further be formed whereby one of the aforementioned hat-like tokens 21 may be fitted onto and suitably joined with its head portion, and whereby elevation or promotion of that player from fireman to engineer may be appropriately recognized and indicated.

The game embodying the present invention is preferably played under rules whereby one hat token 21 will be located at each station 8A–11A, and whereby arrival of a player's token at any one of the four depots 8A–11A will entitle the player to take the hat from that location, provided there is a hat 21 at that location. If not, then the player is required to move from one depot to another, by way of the conjoining shunts 8B–11B, and until he finds a depot containing a hat 21, before that player is entitled to return his playing token (with the engineer's hat superposed thereon to denote his newly acquired rank and authority) to the trackage 3. Movement of a player's token between and from the four depot locations 8A–11A, however, is determined by appropriate rolls of both of the dice 26A–B.

As hereinbefore noted, as long as a player's token 20 is not topped with a hat 21, he may not collect a car from any of the stations 4–7. Once he has acquired a hat 21, however, and his token 20 has thus been elevated or promoted to the rank and privileges of engineer, he is accordingly now "qualified" to operate a locomotive 22, and he may then collect rolling stock 22–25 until he has achieved the objective of assembling all of the rolling stock for a complete train.

It is desired that the present invention simulate or suggest the difficulty which a real-life fireman must overcome in seeking to attain the level and authority of a real-life engineer. It is beyond the scope of the present invention to effectively simulate in any detail the details and rigorous experience of such a training program. However, the difficulty of the real training and qualification program is suggested by subjecting each player to artificial impediments in obtaining a hat for the token representing that players's fireman. In particular, it will be noted that although the player's token can move directly from the trackage 3 to any of the four depots 8A–11A, there must actually be a hat token at that particular one of the four depots 8A–11A If not, the player can only move counterclockwise to the next succeeding depot in the hopes of finding a hat token, and even then he can only move to the succeeding depot if he first rolls both dice 26A–B to come up with a pair of the same numerals. If necessary then, a player may find it necessary to move through as many as all four depot locations 8A–11A on the game board 2, in order to find a hat token, if the other three players have themselves previously taken the other three hats 21.

Another condition in a real-life railroading concerns the fact that a real-life engineer may be suspended or even permanently deprived of his "engineer" status for misconduct or various other reasons, and he then may be required to again repeat the same training and qualification program as a condition for restoration to "engineer" status. In a preferred embodiment of the present invention, loss of "engineer" status may be simulated or suggested as a possibility for the player by introducing conditions whereby the player's token may be deprived of its hat. More particularly, if a hatted player's token moves to any of the four switch locations 3G in the trackage 3, the token is immediately shifted to the closest one of the four depot locations 8A–11A in the center of the game board 2. If there is already a hat token in that particular depot location, and if the player rolls a double upon his next turn with the pair of dice, the player's token may then be returned to the trackage 3 while retaining the hat which denotes his status as an engineer rather than a mere fireman. If there is not a hat at that particular depot location at the time the hatted token enters it, however, the hat on the token must be removed and deposited at that depot, and the player's token then reverts to fireman status.

To recover his status as an "engineer," the player must first move his "non-hatted" token to a depot location containing a hat, and he must thereafter roll a "double" upon his next turn with the pair of dice. If the player rolls a double while his token is at a depot having no unused hat token, he must transfer his unhatted token back to the trackage 3 at the perimeter of the game board 2, and he may not again enter any of the depot locations and obtain another hat for the purpose of recovering his lost "engineer" status, until he again lands his unhatted token on another switch location in the trackage 3. On the other hand, if a player with an unhatted token rolls anything but a pair with his two dice, his unhatted token is not transferred to the trackage 3 as he hereinbefore described, but instead is simply moved to the next succeeding depot location.

If there is a hat then at that new depot location, and if the player also then rolls a pair with the two dice, the player may then fix the hat on his token to denote that he has been restored to his "engineer" status, and he may the transfer his re-hatted token back onto the trackage 3. If there is no hat then at that depot location, the player will thereafter either return unhatted to the trackage 3 as hereinbefore described, or he will move to the next succeeding depot location in further search for his lost "engineer" status, depending upon what he rolls with the two dice.

In the preferred version of the present invention, the subject game is designed to provide a competitive situation for between two and four players. Accordingly, each player will employ a token 20 which, as indicated in the accompanying drawing, is preferably configured in human-like form to resemble a railroad employee and to stand on and occupy a particular space along the track 3 during play.

As also hereinbefore indicated, a token 20 standing by itself indicates that the player associated with that token has the status of "fireman", and that a token 21 must be earned (acquired) before that player achieves the status of "engineer" and thereby becomes entitled to operate a locomotive as denoted by token 22 or the like. As depicted in the accompanying drawing, each token 21 will preferably have the configuration of a hat or other suitable item of headgear, and will preferably be shaped to be releasably interconnected with a player's token 20 by being inserted on to the projection 20A on the top end of the token 20, whereby the privileged status of the player associated with that token 20 will be readily and continually apparent to the other players.

Although each player token 20 may conveniently have the same shape and size, it is necesary for the purposes and rules of the game that each player be enabled at all times to recognize and distinguish his token 20 as well as the tokens 20 of each of his opponents. This may conveniently be achieved by providing each player token 20 with a vivid but different color, such as red, blue, yellow and green. The various hat tokens 21, however, will all be colored the same and preferably black or some other color different from any of the player tokens 20 whereby the presence of a hat 21 on player token 20 will be more easily seen by the other players.

As hereinbefore also indicated, the rolling stock needed to make up a train may be represented in various ways such as by cards bearing a pictorial illustration of a locomotive with tender, a box car, or the like. However, it is preferable for enhancing and sustaining the interest of pre-teen players that a locomotive be represented by a token 22 having a configuration as indicated in the accompanying drawing. Similarly, a box car may be represented by token 23, a tank car by token 34, and a caboose by token 25, as further illustrated in the accompanying drawing.

As hereinbefore stated, different playing rules may be adopted in order to render the game either more or less complicated and time consuming, and therefore to transfer the appeal of the game to either a child or an older and more sophisticated player. Many variations will suggest themselves, however, but in a particularly useful change the player may be permitted to collect cars to assemble a train while nevertheless enjoying only a fireman's status and privileges. However, it should continue to be a requirement that the player also acquire and be in possession of an engineer's hat, in order to be entitled to claim victory because he has all four types of rolling stock, and because he has thereby assembled a complete train for departure from the marshalling yard.

Other variations and changes may be made without actually departing from the essential concept of this game. Accordingly, it should be clearly understood that the particular structures and processes depicted herein, are exemplary only, and does not constitute limitations on the scope of the present invention.

What is claimed is:

1. A board game based on a railroading theme wherein the object is to be the first player to assemble the necessary components of a complete railroad train, the game comprising:

a gameboard having a rectangular playing surface with an array of trackage arranged about its periphery representing a railroad marshalling yard and defining a path of adjacent spaces including a signal block space, a communication space, and a switch space, a plurality of spaced-apart and color-coded starting locations and storage locations along said trackage for related playing pieces, a plurality of spaced-apart depot storage locations disposed inwardly from said peripheral trackage and each interconnected by additional sections of trackage and each interconnected to a switch space of said periperpheral trackage, a plurality of movable employee playing pieces each formed to resemble a railroad employee having the initial status of fireman and each distinctly color-coded to relate to a preselected one of the players of said game and capable of moving on said peripheral and additional sections of trackage, a first plurality of train playing pieces each representative of a locomotive which are initially positioned at one of said storage locations and each color-coded to relate to a preselected one of said players, a second plurality of train playing pieces each representative of a caboose which are initially positioned at one of said storage locations and each color-coded to relate to a preselected one of said players, a third plurality of train playing pieces each representative of different types of railroad rolling stock with each type initially positioned at one of said storage locations respectively and each one of each type color-coded to relate to a preselected one of said players, a plurality of headdress playing pieces each formed to resemble an article of headdress representative of the status of railroad engineer each initially position at one of said depot storage locations and each color-coded to relate to a preselected one of said players, said headdress playing pieces configured to be releasably received on said employee playing pieces to represent the elevation in employee status from a "fireman" which cannot collect said train playing pieces to an "engineer" which can collect said train playing pieces, chance means for randomly establishing the extent of movement of said employee playing pieces along said trackage, and a set of message cards corresponding to said communication spaces on said peripheral trackage which represent various massages sent from a yard dispatcher to a player and instructing the player to move their employee playing piece ahead or back a number of spaces or to advance it to a storage location.

2. A method of playing a board game based on a railroading theme wherein the object is to be the first player to assemble the necessary components of a complete railroad train, the method comprising;

providing a gameboard having a rectangular playing surface with an array of trackage arranged about its periphery representing a railroad marshalling yard and defining a path of adjacent spaces including a signal block space, a communication space, and a switch space, a plurality of spaced-apart and color-coded starting locations and storage locations along said trackage for related playing pieces. a plurality of spaced-apart depot storage locations disposed inwardly from said peripheral trackage and each interconnected by additional sections of trackage and each interconnected to a switch space of said periperpheral trackage, providing a plurality of movable employee playing pieces each formed to resemble a railroad employee having the initial status of "fireman" and each distinctly color-coded to relate to a preselected one of the players of said game and capable of moving on said peripheral and additional sections of trackage, providing a first plurality of train playing pieces each representative of a locomotive which are initially positioned at one of said storage locations and each color-coded to relate to a preselected one of said players, a second plurality of train playing pieces each representative of a caboose which are initially positioned at one of said storage locations and each color-coded to relate to a preselected one of said players. a third plurality of train playing pieces each representative of different types of railroad rolling stock with each type initially positioned at one of said storage locations respectively and each one of each type color-coded to relate to a preselected one of said players, providing a plurality of headdress playing pieces each formed to resemble an article of headdress representative of the status of railroad engineer each initially position at one of said depot storage locations and each color-coded to relate to a preselected one of said players, said headdress playing pieces configured to be releasably received on said employee playing pieces to represent the elevation in employee status from a "fireman" which cannot collect said train playing pieces to an "engineer" which can collect said train placing pieces, providing a chance means for randomly establishing the extent of movement of said employee playing pieces along said trackage, providing a set of message cards corresponding to said communication spaces on said peripheral trackage which represent various messages sent from a yard dispatcher to a player and instructing the player to move their employee playing piece ahead or back a number of spaces or to advance it to a storage location, and placing said message cards face down on said playing surface, assigning one of said employee playing pieces of a particular color to each player and each player placing their assigned employee playing piece in a said starting location of the corresponding color on said peripheral trackage, each player in turn operating said chance means and advancing their employee playing piece in one direction along said peripheral trackage the number of spaces indicated thereby. and, if the player lands on a said signal block space advancing their employee playing piece two additional spaces, if the player lands on a communication space drawing one of said message cards and following the instructions thereon, and if the player lands on a said switch space moving their employee playing piece into one of said depot storage locations connected to said switch space, upon landing in a said depot storage location, and if that depot storage location contains a headdress playing piece, said player taking said headdress playing piece from said depot storage location and placing it on their said employee playing piece, and it that depot storage location does not contain a said headdress playing piece, said player at his next turn then moving along said additional sections of trackage connecting said depot storage locations the number of spaces indicated by said chance means until said player lands on a said depot storage location containing a said headdress playing piece, upon a player acquiring a said headdress playing piece and placing same on said employee playing piece, said employee playing piece becoming elevated in status from a "fireman" which cannot collect said train playing pieces to an "engineer" which can collect said train playing pieces, said player whose playing piece has acquired the status of "engineer" at his next turn still moving along said additional sections of trackage connecting said depot storage locations the number of spaces indicated by said chance means until said chance means indicates a double number or until said player reaches the depot storage location at which they entered on at which time said player may move their "engineer" playing piece back onto said peripheral trackage the number of spaces indicated by said chance means, should a double number be attained prior to their exit by said player moving along said additional sections of trackage connecting said depot storage locations, said player must remove said headdress playing piece from their employee playing piece reducing it's status again to "fireman", place said headdress playing piece on one of said depot storage locations, and move their "fireman" playing piece back onto said peripheral trackage the number of spaces indicated by said chance means, each player whose playing piece has acquired the status of "engineer" and entered back onto said peripheral trackage in their turn operating said chance means and advancing their "engineer" playing piece in one direction along said peripheral trackage the number of spaces indicated thereby, and, if the player lands on one of said storage locations containing a train playing piece representing a locomotive, a caboose, or a type of rolling stock, said player collecting said train playing piece corresponding to the color of their employee playing piece, and play of the game continuing as described above until one player has collected one locomotive playing piece, a caboose playing piece, and one of each type of rolling stock playing piece.

* * * * *